US007022032B2

(12) United States Patent
Chen

(10) Patent No.: US 7,022,032 B2
(45) Date of Patent: Apr. 4, 2006

(54) GOLF CLUB HEAD AND MANUFACTURING METHOD THEREFOR

(75) Inventor: Yun-Fang Chen, Taoyuan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 0 days.

(21) Appl. No.: 10/423,989

(22) Filed: Apr. 28, 2003

(65) Prior Publication Data

US 2004/0214660 A1 Oct. 28, 2004

(51) Int. Cl.
*A63B 53/04* (2006.01)

(52) U.S. Cl. ..... 473/346; 473/342; 473/345; 473/347; 473/349; 473/409; 156/154

(58) Field of Classification Search ..... 473/328, 473/345, 349, 344, 346, 332, 342, 343, 347, 473/348; 156/292, 293, 154
See application file for complete search history.

(56) References Cited

U.S. PATENT DOCUMENTS 5,303,922 A * 4/1994 Lo ..... 473/330
5,410,798 A * 5/1995 Lo ..... 29/527.2
5,431,396 A * 7/1995 Shieh ..... 473/329
5,527,034 A * 6/1996 Ashcraft et al. ..... 473/330
5,816,936 A * 10/1998 Aizawa et al. ..... 473/342
5,993,329 A * 11/1999 Shieh ..... 473/329
6,089,070 A * 7/2000 Hancock et al. ..... 72/340
6,117,023 A * 9/2000 Onuki et al. ..... 473/342
6,319,149 B1 * 11/2001 Lee ..... 473/342
6,368,233 B1 * 4/2002 Chen ..... 473/342
6,434,811 B1 * 8/2002 Helmstetter et al. ..... 29/407.08
6,575,845 B1 * 6/2003 Smith et al. ..... 473/329
6,634,958 B1 * 10/2003 Kusumoto ..... 473/310
6,645,086 B1 * 11/2003 Chen ..... 473/335
6,663,504 B1 * 12/2003 Helmstetter et al. ..... 473/329
6,676,536 B1 * 1/2004 Jacobson ..... 473/329
6,746,344 B1 * 6/2004 Long ..... 473/346
2002/0055396 A1 * 5/2002 Nishimoto et al. ..... 473/345
2005/0026717 A1 * 2/2005 Jones et al. ..... 473/340

* cited by examiner

*Primary Examiner*—Nini F. Legesse
(74) *Attorney, Agent, or Firm*—Bacon & Thomas, PLLC

(57) ABSTRACT

A golf club head and manufacturing method. The method includes the steps of: selectively forming through holes on a surface of a golf club head; preparing carbon-fiber plates which are made of prepared carbon-fiber fabrics; providing a cushion channel between an outer periphery of the carbon-fiber plate and an inner periphery of the through hole while each of the carbon-fiber plate is combined with the associated through hole of the golf club head; filling the cushion channel with a filler; and finishing the golf club head to produce an end product.

3 Claims, 9 Drawing Sheets

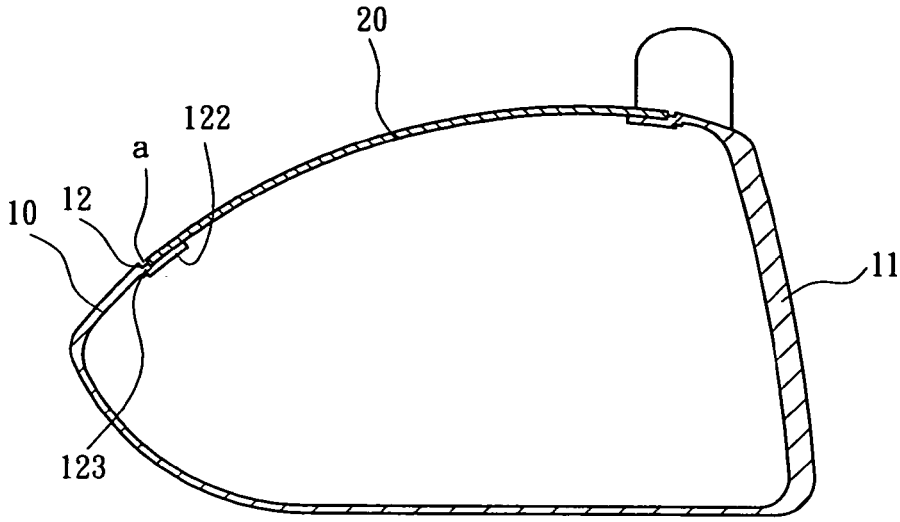
F I G . 7
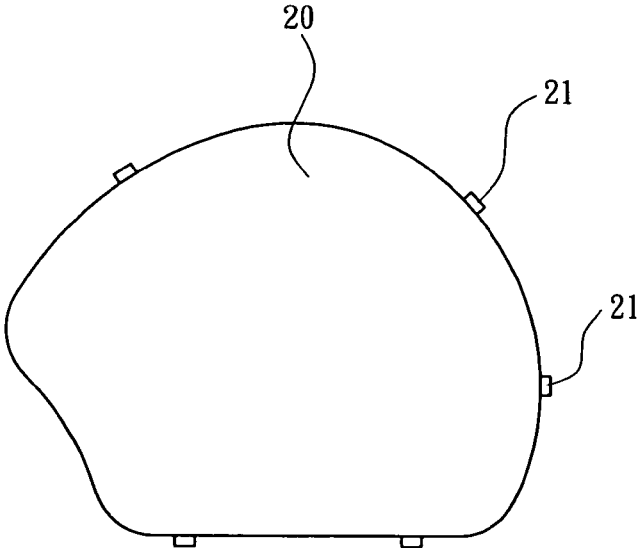
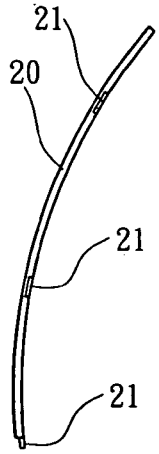
F I G . 8 F I G . 9

GOLF CLUB HEAD AND MANUFACTURING METHOD THEREFOR

BACKGROUND OF THE INVENTION

1. Field of the Invention

The present invention is related to a golf club head and a manufacturing method therefor. More particularly, the present invention is related to a cushion channel remained between through holes of the main body of the golf club head and prepared carbon fiber plates as well as related to a elastic colored filler filled in the cushion channel to prevent wrinkle on the periphery of the through holes and the carbon fiber plates.

2. Description of the Related Art

A conventional golf club head mainly includes a main body and a striking plate attached thereto, all of which are made of metal or alloy. The main body is formed as a single member by casting or consisted of a crown plate, a sole plate and a side plate by welding. As to the striking plate, it is attached to a front surface of the main body by incorporating, welding or embedding. To meet various requirements, manufacture may change the configuration and the structural connection of the main body and the striking plate to lower its center of gravity and its total weight. Since the main body is made of metal, the center of gravity and the total weight of the main body cannot be effectively adjusted specific.

Another conventional golf club head mainly includes a metal main body formed with an opening at its top and regarded as a filling portion. Plurality of prepared carbon-fiber fabrics are piled up and used for attaching to the opening of the main body and sealing it. The prepared carbon-fiber fabrics have plasticity before heating and hardening it. Firstly, the main body is placed in a die assembly and an air-inflating bag is used to support the prepared carbon-fiber fabrics on the main body so that the main body can be formed with a carbon-fiber portion. Light material of the carbon-fiber portion may cause reduction of weight and thus the center of gravity and the total weight of the main body can be adjusted specific. By manufacturing such large carbon-fiber portion, has sophisticated the manufacture processes of the prepared carbon-fiber fabrics and prolonged the manufacture time. In manufacture operation, it reduces the product quality due to irregular deformation of the prepared carbon-fiber fabrics. Moreover, a large area of the prepared carbon-fiber fabrics may weaken the entire structural strength of the main body and it may lower its striking sound instead of a sharp striking sound making by a metal golf club head.

Another conventional golf club head and the manufacturing method therefor are shown as FIGS. 1 and 2. A wood type golf club head has a main body 10 and a striking plate 11. The main body 10 retains most of the metal shell thereof but has a plurality of through holes 12 on the crown plate, the sole plate or the side plate. The through holes 12 are provided with stepped portions 121 for fitting with plural prepared and light carbon-fiber plates 20 (or weighing member 30). Therefore, the main body 10 may not only have a low gravity center, less weight and sharp striking sound but also have a short manufacture process and better quality. The main body 10 may change the position of gravity center and entire weight quickly by means of adjusting the number, size and weight of the through holes 12, the carbon-fiber plates 20 and the weighting member 30. However, when the carbon-fiber plates 20 are closely fitted with the through holes 12, the interface therebetween easily deforms frequently, and wrinkles appeared thereon. This influences the appearance and quality of the products. Therefore, it is necessary to implement the conventional golf club head and the manufacture method therefor.

The present invention intends to implement the drawbacks mentioned above. In the present invention, a cushion channel is remained between the through hole of the golf club head and the carbon-fiber plates. The cushion channel is provided with an appropriate clearance for the absorbing deformation to reduce the wrinkles and the influence thereof on the entire structural strength. Moreover, the cushion channel may also be filled with elastic colored filler to enhance the appearance of the product.

SUMMARY OF THE INVENTION

The primary objective of this invention is to provide a golf club head and a manufacturing method therefor, wherein a cushion channel is remained between the through holes on the main body of the golf club head and the carbon-fiber plates to form an appropriate clearance for absorbing deformation to reduce the wrinkles and the influence thereof on the entire structural strength.

The secondary objective of this invention is to provide the golf club head and the manufacturing method therefor, wherein a cushion channel is remained between the through holes on the main body of the golf club head and the carbon-fiber fabrics, and is filled with elastic colored filler to enhance the appearance of the product.

The manufacturing method for the golf club head in accordance with the present invention comprises steps of: forming a plurality of through holes on the surface of the golf club head; preparing a plurality of carbon-fiber plates by carbon-fiber fabrics; remaining a cushion channel between the through hole and the carbon-fiber plate when assembling; filling filler into the cushion channel; processing the main body of the golf club head to thereby produce the final product.

BRIEF DESCRIPTION OF THE DRAWINGS

The present invention will now be described in detail with reference to the accompanying drawings herein:

FIG. 7 is a cross sectional view of the golf club head in accordance with the second embodiment of the present invention, which shows the cushion channel;

FIG. 8 is a top view of a carbon-fiber plate with short fingers on the peripheral thereof in accordance with the third embodiment of the present invention;

FIG. 9 is a side view of a carbon-fiber plate in accordance with the third embodiment of the present invention;

DETAILED DESCRIPTION OF THE INVENTION

Figure 1:
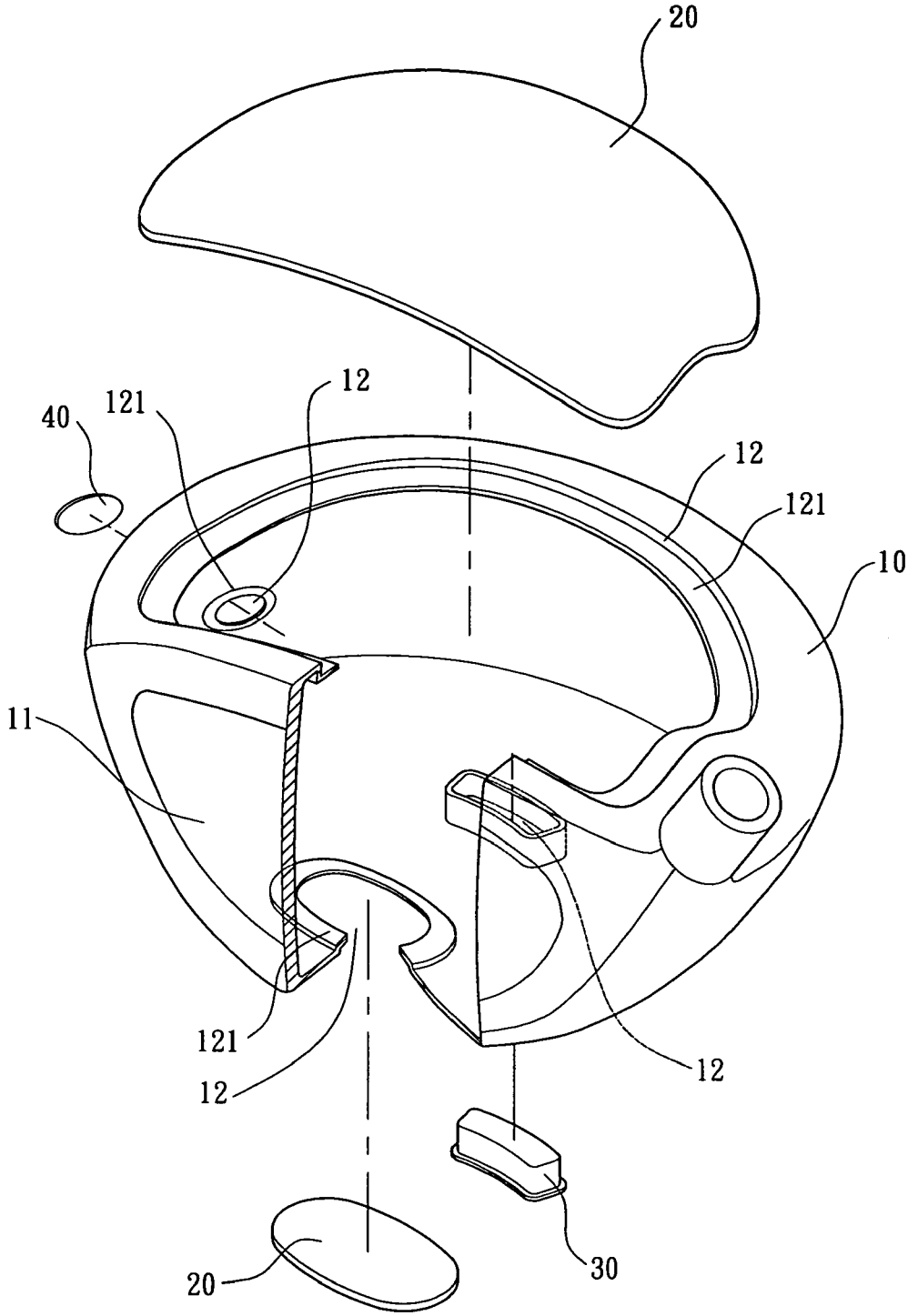
F I G . 1 PRIOR ART
FIG. 1 is a exploded perspective view of a conventional golf club head.
Figure 2:
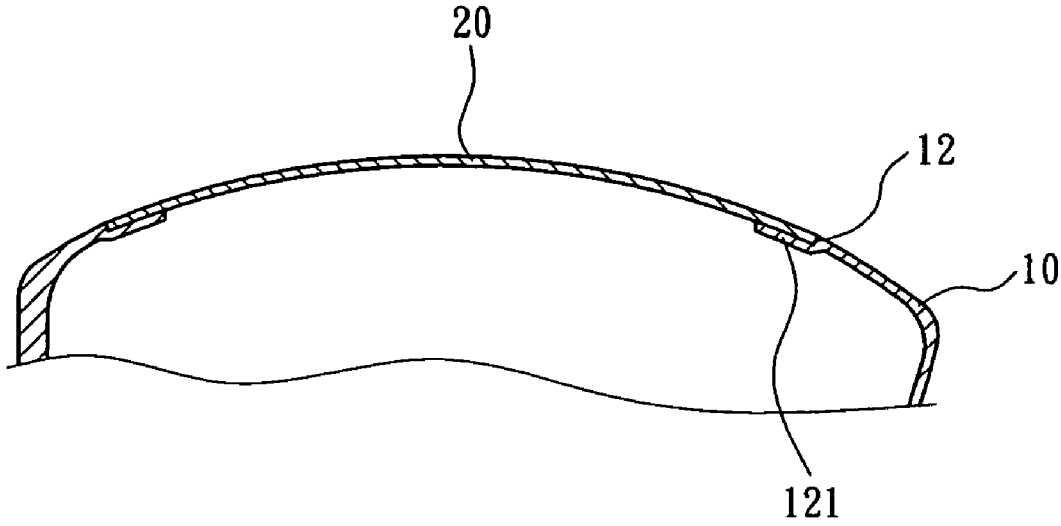
F I G . 2 PRIOR ART
FIG. 2 is a partial exploded perspective view of a conventional golf club head.

The structure and manufacture process are partially same with the conventional one as shown in FIG. 1, therefore, the identical part is given the same index symbol and neglect the description as well.

Figure 3:
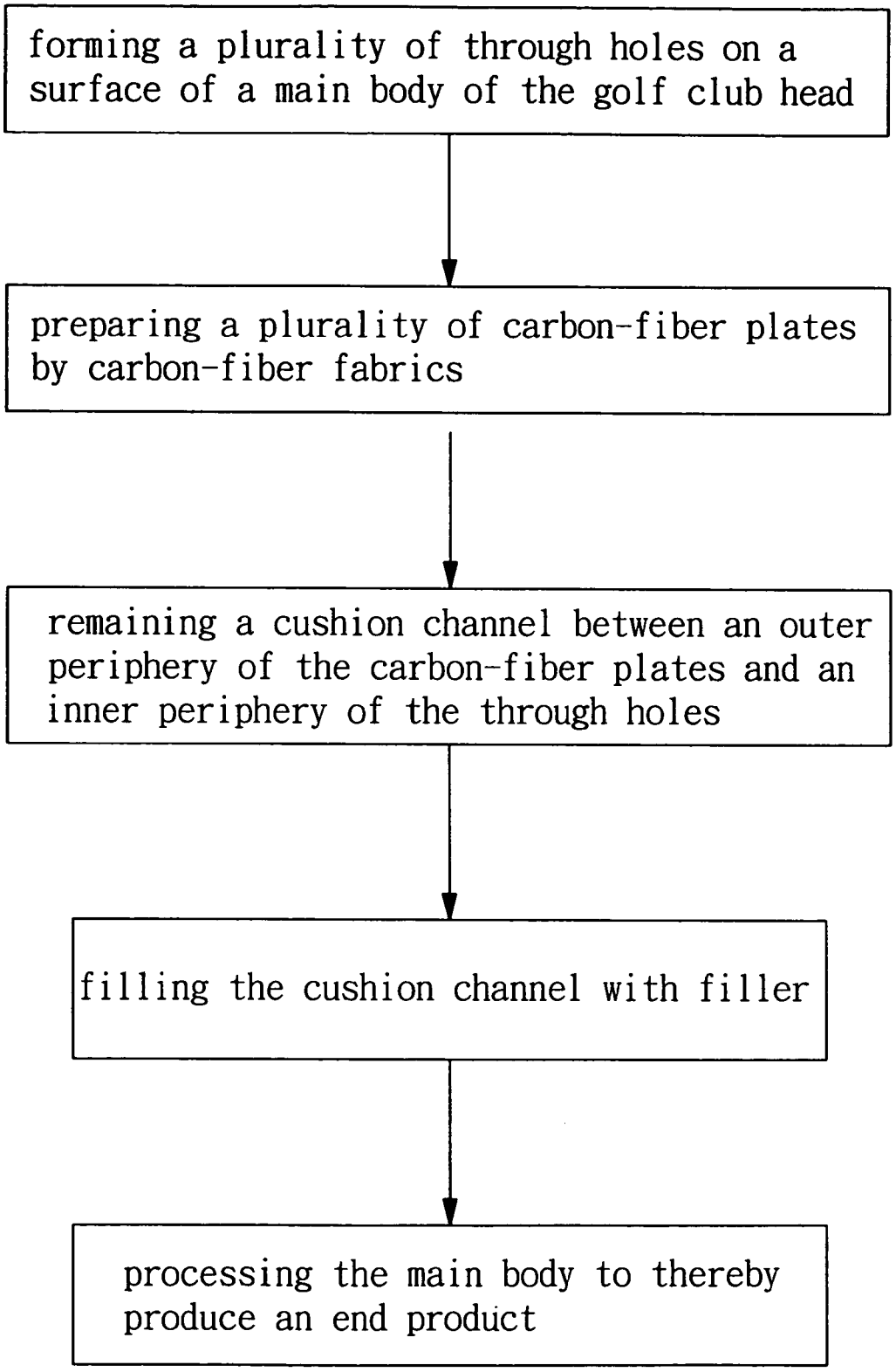
FIG. 3 is a flow chart of the manufacture method of the golf club head in accordance with the present invention.
Figure 4:
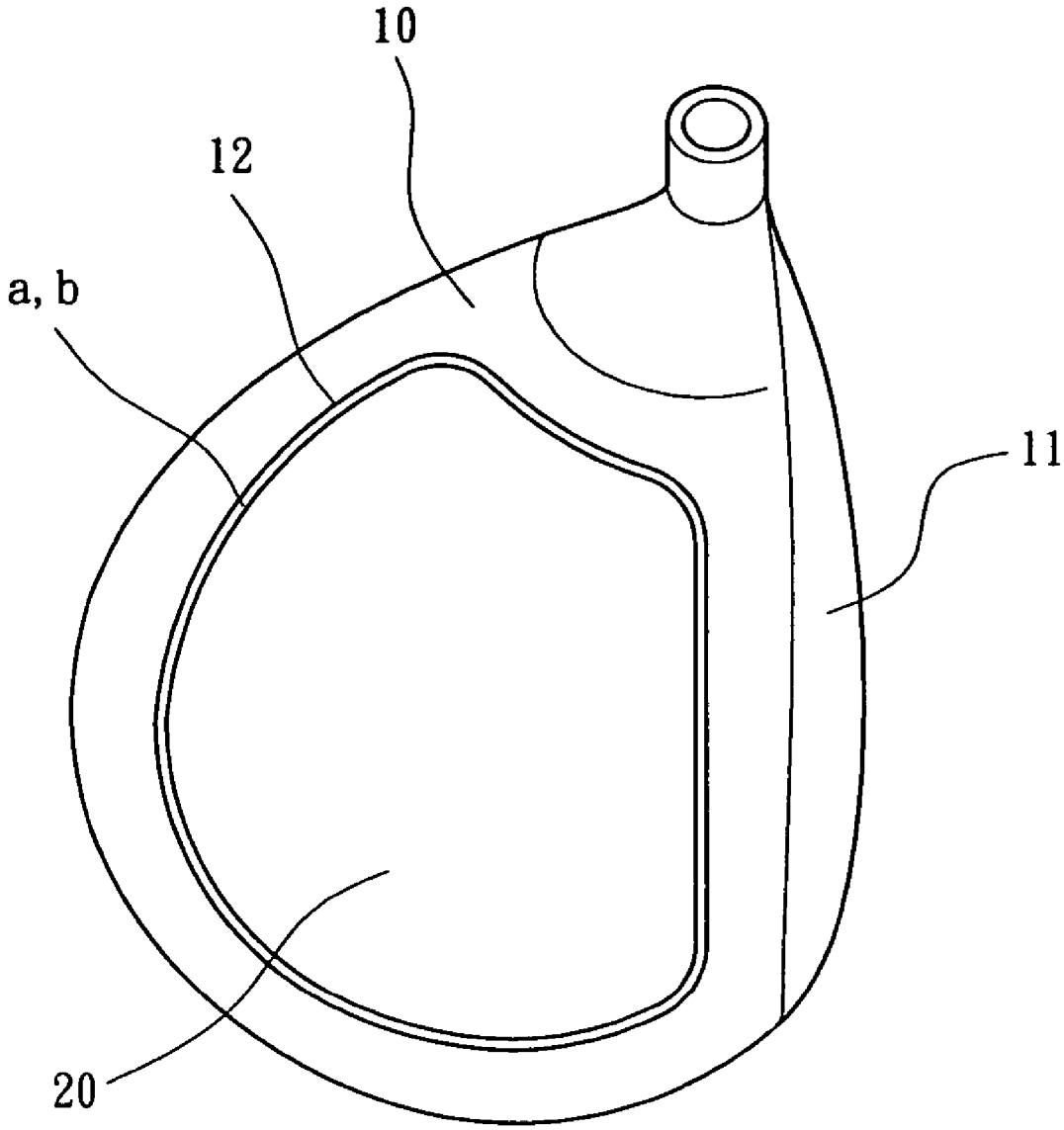
FIG. 4 is a top view of golf club head in accordance with the first embodiment of the present invention, which shows the cushion channel.

Referring to FIGS. 3 and 4, the first step of the manufacture method in accordance with the first embodiment of the present invention is forming a plurality of through holes 12 on the surface of the main body 10 of the golf club head. The main body 10 is preferably formed as a single member by casting and the material thereof can be stainless steel, titanium alloy, or iron etc. A striking plate 11 is attached to the front of the main body 10 by welding, integrally forming or embedding. An appropriate amount of the through holes 12 are formed on the crown plate, the sole plate or the side plate of the main body 10. A stepped portion 121 is formed on the peripheral of the through holes 12 for supporting a carbon-fiber plate 20, a weighting member 30 and a name plate 40 (as shown in FIG. 1) of predetermined size in the following procedure.

Referring to FIGS. 3 and 4, the second step of the manufacture method in accordance with the first embodiment in the present invention is preparing a plurality of carbon-fiber plates 20 by means of carbon-fiber fabrics for hastening the following procedure and promoting the quality of the product. The present invention utilizes plural layers of plastic carbon-fiber fabrics cross-stacked in a press block (not shown) which may press the carbon-fiber fabrics. In a heating process, the pressed carbon-fiber fabrics are hardened to produce the carbon-fiber plates 20 having a predetermined size. Preferably, 4 to 10 layers of carbon-fiber fabrics are arranged in the cross-stacked angle of 0°, 90° or ±45° and heated at 130° C. for 20 minutes. In the first embodiment of the present invention, the outer periphery of the carbon-fiber plate 20 is approximately equal to the inner periphery of the through hole 12. Therefore, the periphery of the carbon-fiber plate 20 and the through hole 12 can be milled to thereby form a clearance in the following process.

Moreover, as shown in FIGS. 4 and 11 through 13, the amount, size and weight of the through hole 12, carbon-fiber plate 20 and weight 30 may be changed according to requirement. Thereby, the position of gravity center and weight of the main body 10 can be largely adjusted in the invention. Because the main body 10 is made of metal, a sharp sound will occur when striking. The carbon-fiber plate 20 can be replaced by other non-metal plate with less weight and high strength, e.g. polymer plastic material and high-strength fiber material.

Figure 5:
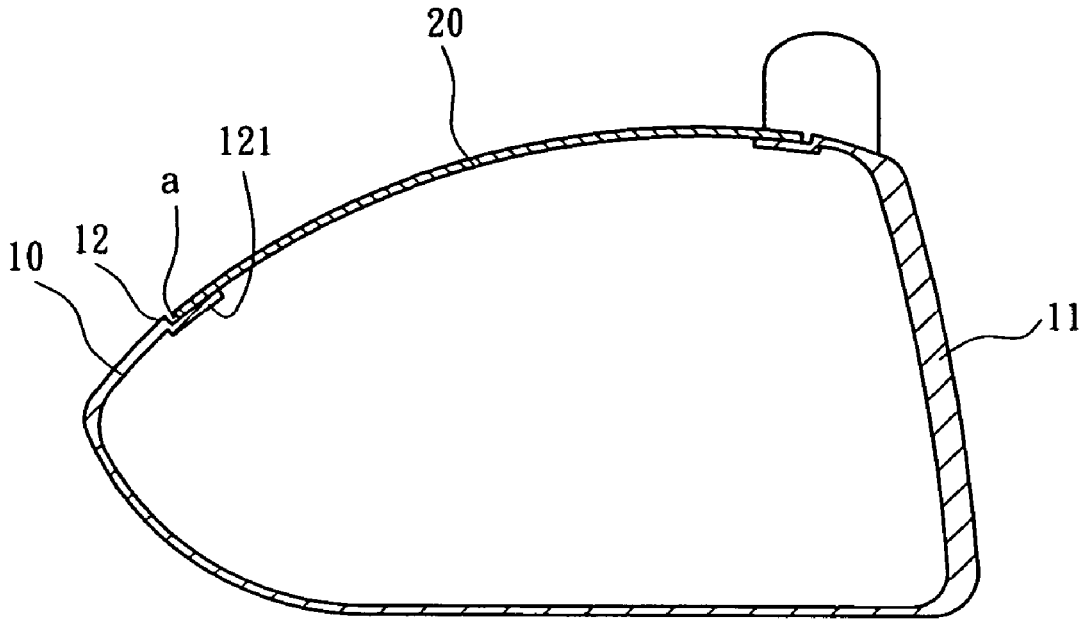
FIG. 5 is a cross sectional view of the golf club head in accordance with the first embodiment of the present invention, which shows the cushion channel.
Figure 6:
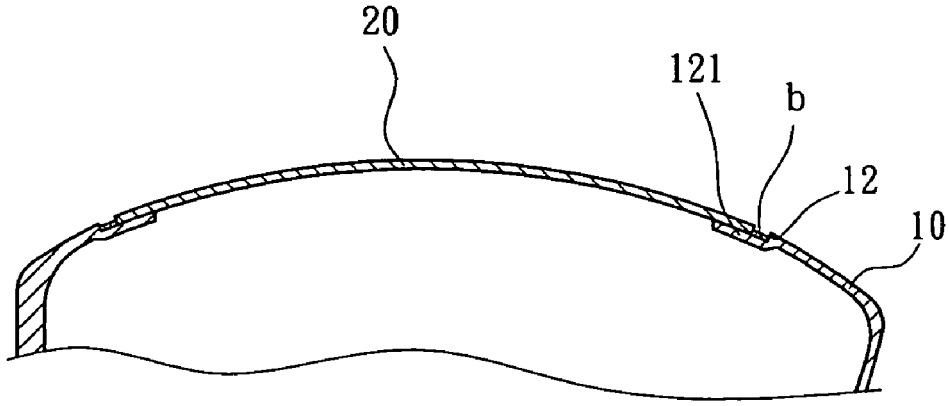
FIG. 6 is a cross sectional view of the golf club head in accordance with the first embodiment of the present invention, which shows the elastic colored filler filled in the cushion channel.
Figure 10:
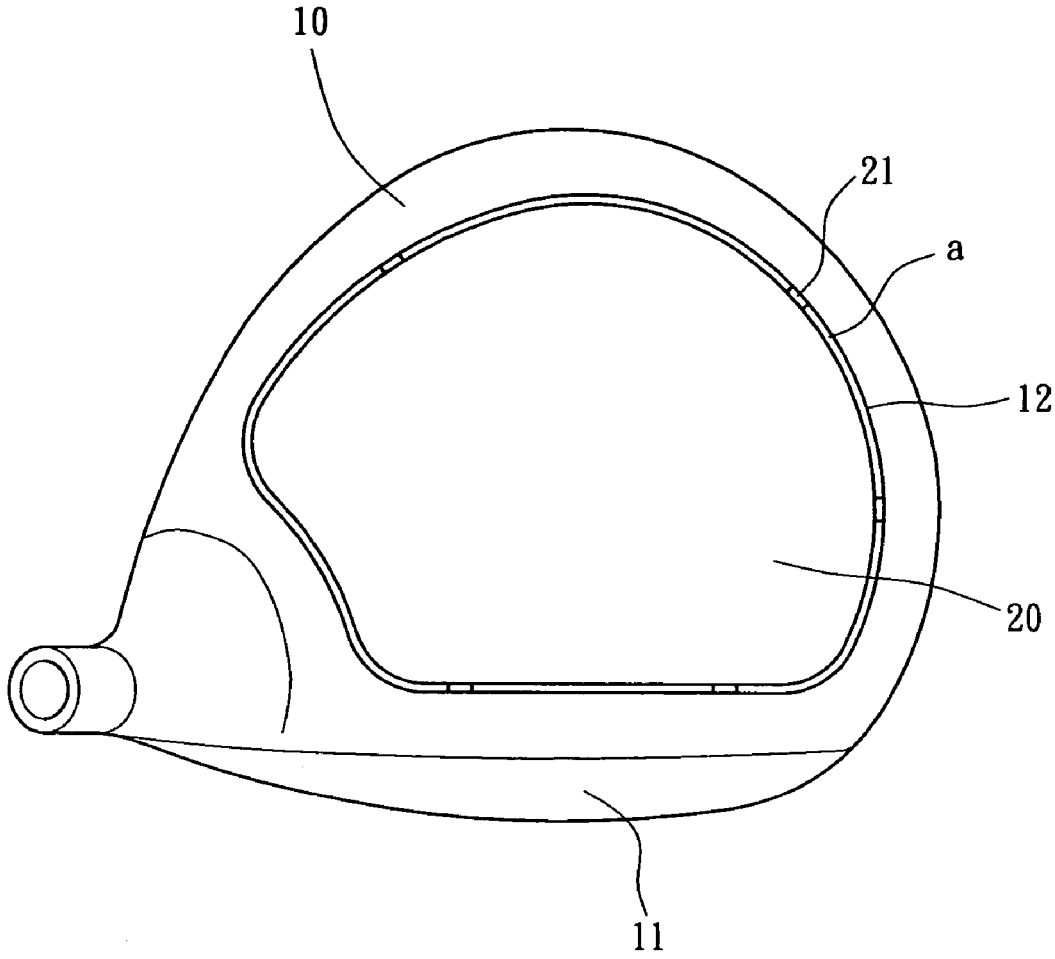
FIG. 10 is a cross sectional view of the golf club head in accordance with the third embodiment of the present invention, wherein the cushion channel is formed by means of the short fingers.

Referring to FIGS. 3 through 5, the third step of the manufacture method in accordance with the first embodiment in the present invention is providing a cushion channel between the periphery of the carbon-fiber plate 20 and the periphery of the through hole 12.

The carbon-fiber plate 20 in the invention is bonded to the corresponding through hole 12 on the main body 10 by means of epoxy resin. Moreover, before or after the bonding, a CNC milling can be used to remove a peripheral portion of the material of the carbon-fiber plate 20 and the through hole 12 of the main body 10 so as to form a cushion channel with a uniform width or various widths. Therefore, the clearance is adapted to cushion, thereby reducing the possibility of wrinkles and maintain the strength of the entire main body 10. The cushion channel can also be formed between the weighting member 30, the name plate 40 and the corresponding through holes 12 by CNC milling.

Referring to FIGS. 3 through 6, the fourth step of the manufacture method in accordance with the first embodiment in the present invention is filling the filler b in the cushion channel a. When the cushion channel a is formed by CNC milling, an appropriate filler b can be filled therein. The filler b is preferably elastic colored filler, especially made from heat plastic elastoplasts with color, e.g. PU paint filler. The filler b is filled in the cushion channel a and hardened. The elasticity and color of the filler b may enhance the appearance and product price of the main body 10 without affecting the cushion effect. Moreover, as shown in FIGS. 4 and 11 through 13, the main body 10 may have various color, lines and patterns by filling different colored filler b in the cushion channel a, changing the contour of the through hole 12 and the carbon-fiber plate 20, or forming the cushion channel a with a uniform width or various widths.

Referring to FIGS. 3 and 4, the fifth step of the manufacture method in accordance with the first embodiment in the present invention is processing the main body 10 to produce an end product. When the carbon-fiber plate 20, the weighting member 30 and the name plate 40 are bonded to the corresponding through holes 12 of the main body 10, the main body 10 can be polished and finished by precision machining process to remove unnecessary resin and carbon fiber. Then the painting and packaging process are treating on the end product to thereby have better appearance and uniform feature.

Referring to FIGS. 3, 4 and 7, the second embodiment of the present invention is disclosed. Compared with the first embodiment, the third step of the second embodiment is provided with a first stepped portion 122 and a second stepped portion 123 to form the cushion channel a. The first and second stepped portion 122, 123 is preferably integrally formed with the through hole 12 of the main body 10 by casting so that the carbon-fiber plate 20 may be attached to the first stepped portion 122 by loose-fitting. The inner periphery of the through hole 12, the second stepped portion 123 and the outer periphery of the carbon-fiber plate 20 commonly define the cushion channel a. The cushion channel a provides a clearance for the elastic deformation of the carbon-fiber plate 20 and the through hole 12. Moreover, as shown FIG. 4, various elastic colored fillers b can be filled in the cushion channel a so as to promote the appearance and product price of the main body 10 without affecting the cushion effect.

Figure 11:
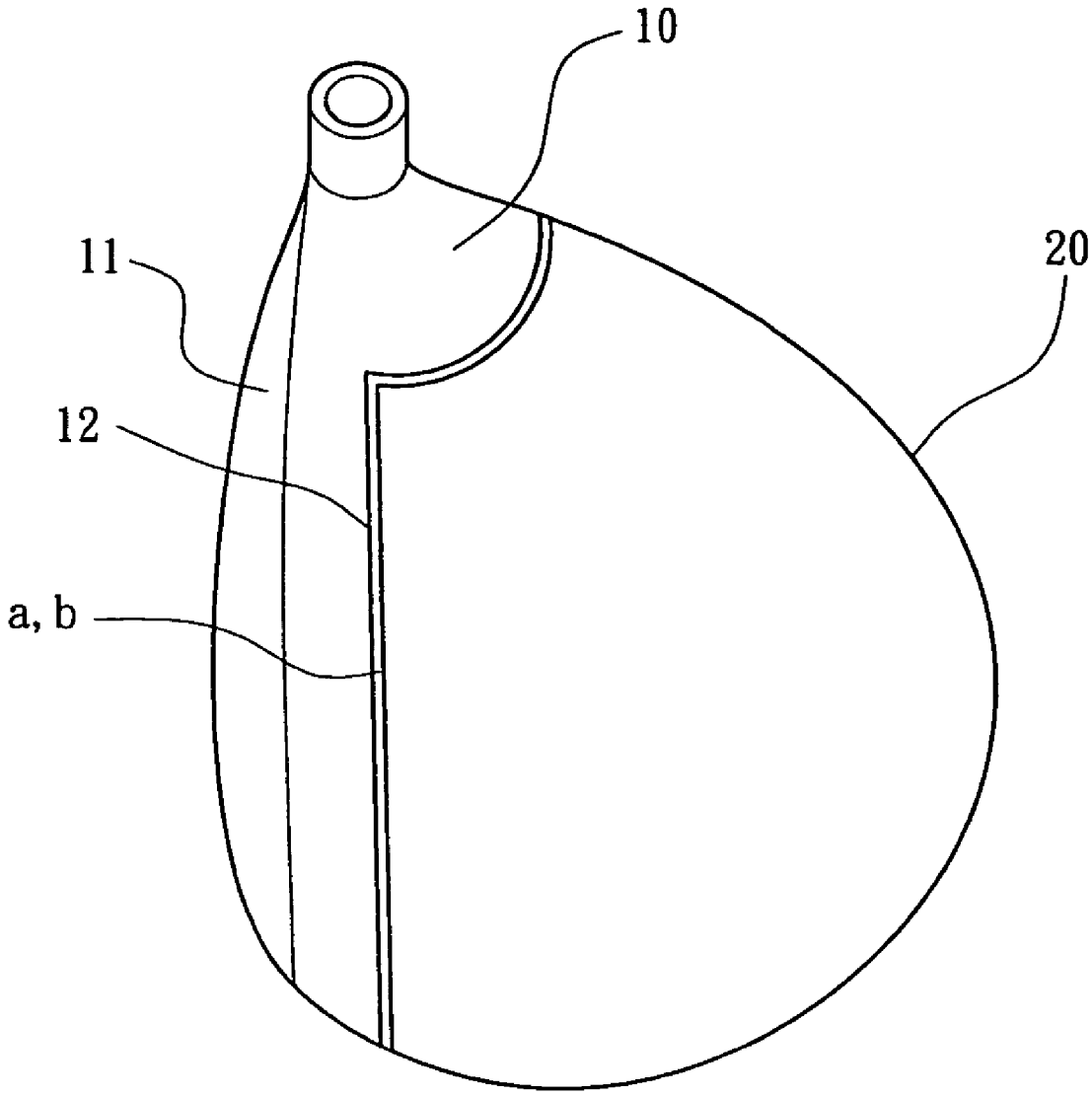
FIG. 11 is a top view of another golf club head in the present invention.
Figure 12:
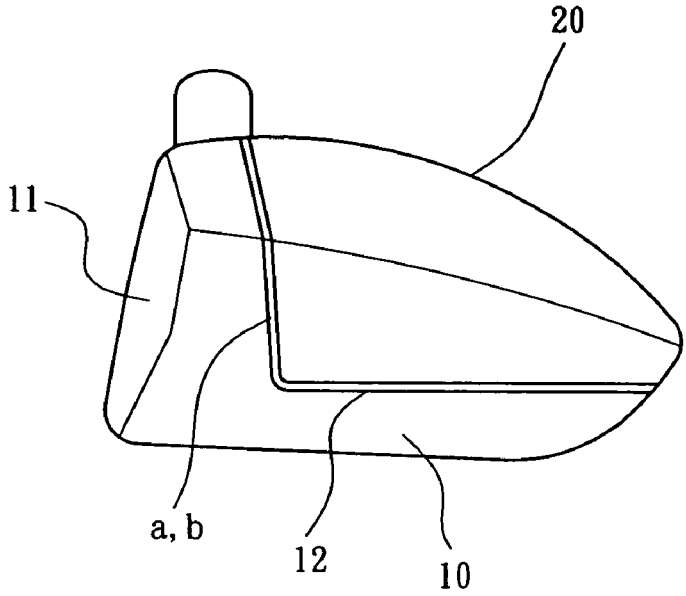
FIG. 12 is a side view of the golf club head in FIG. 11.
Figure 13:
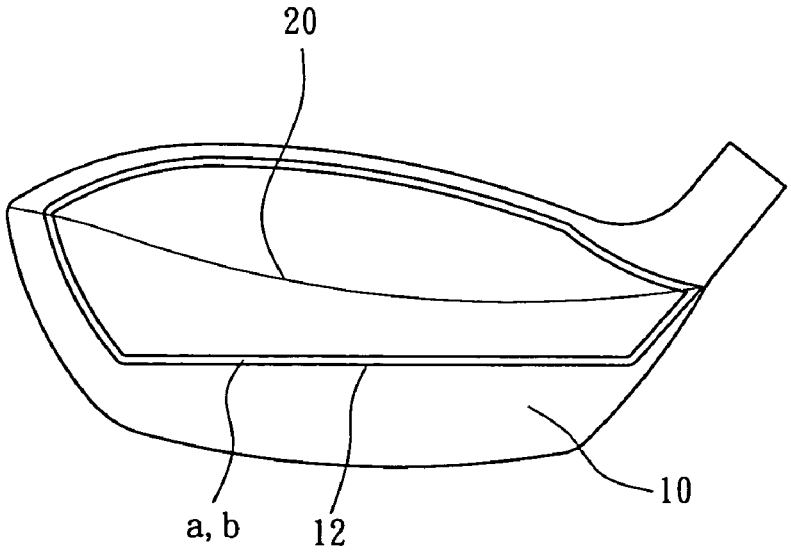
FIG. 13 is a rear view of the golf club head in FIG. 11.

Furthermore, as shown in FIGS. 11 through 13, when the size of the through holes 12 and the carbon-fiber plate 20 is too large to form cushion channel a, it a is disadvantage of a CNC milling process to mill the periphery of the through holes 12 and the carbon plate 20. Alternatively, a first stepped portion 122 and a second stepped portion 123 of the second embodiment in the present invention can be used to position the large carbon-fiber plate 20 on the large through holes 12 so as to form the cushion channel with a uniform width or various widths.

Referring to FIGS. 3, 4 and 8 through 10, the third embodiment of the present invention is disclosed. Compared with the first and second embodiments, the third step of the manufacture method in the third embodiment is provided with plural short fingers 21 on the outer periphery of the carbon-fiber plate 20 to maintain the cushion channel a. The size of the outer periphery of the carbon-fiber plate 20 in the embodiment is slightly smaller than that of the inner periphery of the through hole 12. When the carbon-fiber plate 20 is bonded on the stepped portion 121, the short fingers 21 on the carbon-fiber plate 20 extend outwardly to confront with the inner periphery of the through hole 12 to form a cushion channel a and a clearance therebetween for cushioning. As shown in FIG. 9, the short fingers 21 can be integrated with the carbon-fiber plate 20 by CNC milling a large outer periphery of the carbon-fiber plate 20 to form a plurality of outwardly extended fingers. The thickness of the short fingers 21 is preferably thinner than that of the outer periphery of the carbon-fiber plate 20 to thereby avoid the short fingers 21 sticking out of the filler b.

As shown in FIGS. 11 through 13, the short fingers 21 of the carbon-fiber plate 20 in the third embodiment can also be adapted to support a large carbon-fiber plate 20 on a large through hole 12 for forming cushion channel a with a uniform width or various widths.

As described above, the conventional carbon-fiber plate 20 is closely fitted with the through hole 12 on the main body 10, thereby plastic deformation and wrinkles occur constantly. However, the golf club head and the manufacture method therefor in the present invention indeed maintain the structural strength of the main body 10 and promote the quality and the product price.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A manufacturing method for a golf club head, comprising the steps of:

forming at least one through hole on a surface of a main body of the golf club head;

preparing at least one carbon-fiber plate formed by carbon-fiber fabrics;

providing a cushion channel between an outer periphery of the carbon-fiber plate and an inner periphery of the through hole; and filling the cushion cannel with elastic filler made from non-metal material;

wherein a size of the carbon-fiber plate is smaller than that of the through hole, and a plurality of short fingers are provided on the outer periphery of the carbon-fiber plate and extend outwardly to confront with the inner periphery of the through hole so as to form the cushion channel therebetween such that the carbon-fiber plate positioned in the through hole precisely defines the cushion channel.

2. The manufacturing method as defined in claim 1, wherein the short fingers are formed on the outer periphery of a large periphery of the carbon-fiber plate by CNC milling.

3. A golf club head comprising:

a main body provided with a striking plate, a crown plate, a sole plate, and a side plate, said main body formed with at least one through hole;

a cushion channel formed between an outer periphery of the carbon-fiber plate and an inner periphery of the through hole; and an elastic fiber filled in the cushion channel, said elastic fiber made of a non-metal material;

wherein a plurality of short fingers are provided on the outer periphery of the carbon-fiber plate and extend outwardly to confront with the inner periphery of the through hole.

* * * * *